United States Patent [19]

Langenbach

[11] Patent Number: 4,602,460

[45] Date of Patent: Jul. 29, 1986

[54] WATER POWERED GUTTER AND DOWNSPOUT CLEANING APPARATUS

[75] Inventor: John F. Langenbach, St. Louis, Mo.

[73] Assignee: John F. Langenbach, St. Louis, Mo.

[21] Appl. No.: 595,946

[22] Filed: Apr. 2, 1984

[51] Int. Cl.[4] ..... E04D 13/08

[52] U.S. Cl. ..... 52/1; 15/104.1 R; 52/16; 210/111

[58] Field of Search ..... 52/1, 16; 417/406; 137/242; 210/111; 15/104.3

[56] References Cited

U.S. PATENT DOCUMENTS

| | | | |
|---|---|---|---|
| 1,365,210 | 1/1921 | Tucker | 417/406 |
| 1,403,699 | 1/1922 | Loewenthal | 417/406 |
| 2,100,560 | 11/1937 | Kennedy | 417/406 |
| 2,739,662 | 3/1956 | Sofia | 210/111 |
| 2,887,073 | 5/1959 | Thompson | 52/16 |
| 3,157,002 | 2/1962 | Herman | 50/5 |
| 3,426,487 | 2/1969 | Forte | 52/1 |
| 3,638,369 | 2/1972 | Albrecht | 52/16 |
| 4,014,074 | 3/1977 | Faye | 16/135 |
| 4,241,547 | 12/1980 | Bove | 52/11 |
| 4,319,851 | 3/1982 | Arthur | 401/137 |
| 4,363,335 | 12/1982 | Tapper | 134/167 |

*Primary Examiner*—Henry E. Raduazo

*Attorney, Agent, or Firm*—Senniger, Powers, Leavitt and Roedel

[57] ABSTRACT

A cleaning apparatus for unclogging a gutter downspout of debris comprising a motor connected to a source of power and mounted above the downspout, auger means positioned within the downspout and rotated by the motor, and means for supplying power to the motor when water in the gutter attains a predetermined level in order to actuate the motor and for discontinuing the supply of power to the motor when the level of water drops to a second but substantially lower level thereof.

4 Claims, 2 Drawing Figures

WATER POWERED GUTTER AND DOWNSPOUT CLEANING APPARATUS

BACKGROUND OF THE INVENTION

This invention relates generally to apparatus for unclogging a gutter downspout of debris, and more particularly to such an apparatus which is water-powered and automatically actuated when the mouth of the gutter downspout becomes clogged.

Most homes and other buildings have roofs which are pitched or sloped to prevent the accumulation of water on the roof. In order to prevent the rain water which runs off a pitched roof from seeping in and around the foundation of the building, a gutter is generally mounted just under the terminal edge or eaves of the roof to catch the water and downspouts lead it away from the foundation of the house.

Over the course of time, the gutters tend to accumulate debris, such as leaves, twigs and other solid debris which are deposited in the gutter either by the action of water running off the roof, or by the wind. A major portion of the debris usually accumulates at the mouth of the downspout thereby blocking the flow of water from the gutter and causing the water to spill over and accumulate at the foundation of the building. Once this occurs it is normally necessary to climb a ladder up to the gutter and manually remove the debris from the gutter and particularly around the mouth of the downspout. With multiple-story buildings this technique is not only troublesome and inconvenient, but also quite dangerous.

Reference may be made to U.S. Pat. Nos. 4,319,851, 4,363,335, 4,241,547, 4,014,074, 3,638,369 and 3,157,002 all of which disclose gutter cleaning devices generally in the field of this invention.

SUMMARY OF THE INVENTION

Among the several objects of this invention may be noted the provision of an improved gutter and downspout cleaning apparatus which allows the gutter and downspout to be cleaned of debris without having to climb up to the eaves of the roof; the provision of a gutter and downspout cleaning apparatus which automatically operates when the downspout becomes clogged and automatically stops operation when the downspout has been cleared of debris; the provision of a gutter and downspout cleaning apparatus which does not require a supply of electric power in order to operate; the provision of a gutter and downspout cleaning apparatus which is efficient and dependable in operation; and the provision of a gutter and downspout cleaning apparatus which is simple and inexpensive to install and maintain.

Generally, cleaning apparatus of this invention comprises a motor for connection to a source of power and mounted above the downspout, auger means adapted to be positioned within the downspout and rotated by the motor, and means for supplying power to the motor when water in the gutter attains a predetermined level in order to actuate the motor and for discontinuing the supply of power to the motor when the level of water drops to a second but substantially lower level thereof.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 2:
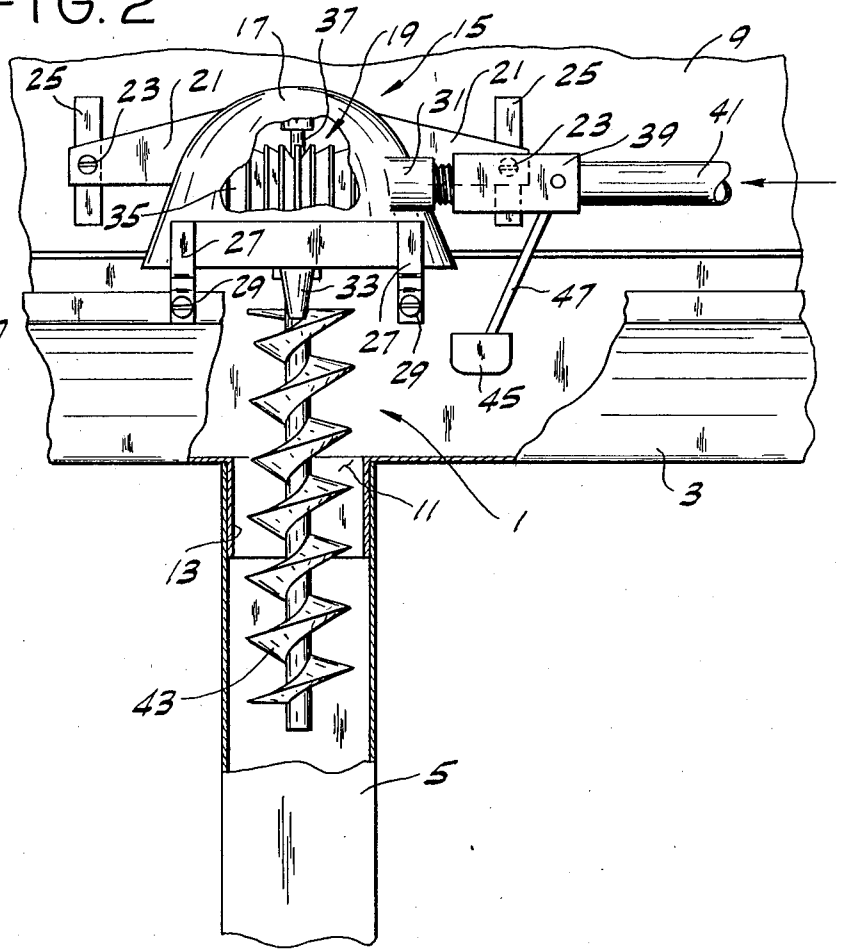
FIG. 2 is a front elevation of FIG. 1 with parts partially broken away to illustrate details.
Figure 1:
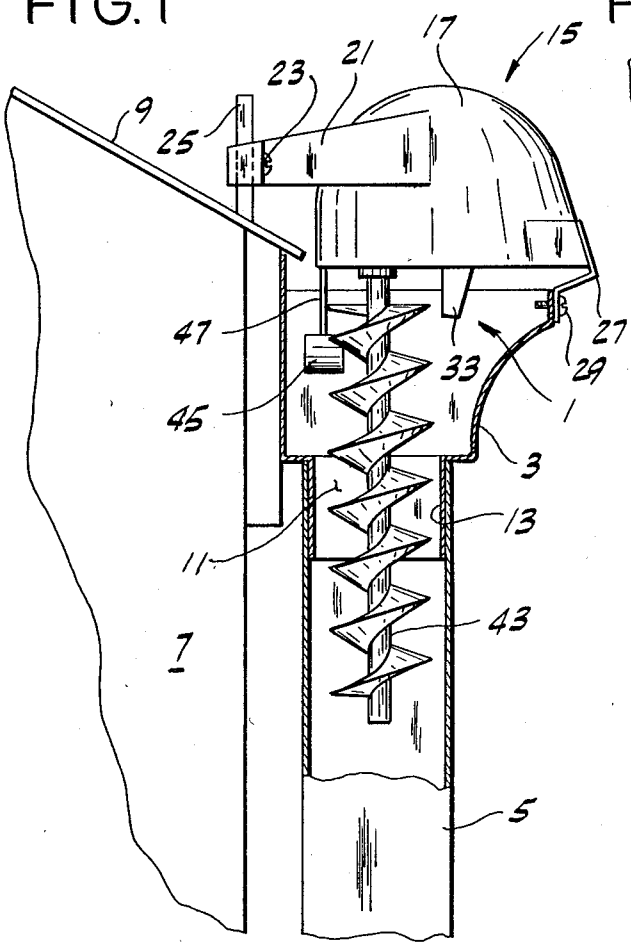
FIG. 1 is a side elevation of a water-powered gutter and downspout cleaning apparatus of this invention mounted on the roof of a building above a downspout.

Referring now to the drawings, cleaning apparatus of this invention, designated in its entirety by the reference numeral 1, is shown mounted in position to remove accumulated debris from a gutter 3 and downspout 5 of a building 7. The gutter 3, is generally channel-shaped and positioned along the eaves of the building so that it juts outwardly beyond the edge of the roof 9 in order to catch water running off the roof. The gutter further has an opening 11 in its bottom with a downwardly depending nipple 13 at the periphery of the opening. The downspout 5 is generally of tubular shape and attached at its uppermost end to nipple 13 and depends downwardly, generally along the side of the building so as to carry the water in the gutter away from the foundation of the building.

The cleaning apparatus 1 comprises a motor 15 having a dome-shaped housing 17 and a rotor 19. The housing is preferably a one-piece molded plastic part (molded of nylon, for example) having a pair of mounting ears 21 extending outwardly and rearwardly therefrom. The ears are secured by means of screws 23 to rear mounting brackets 25 which are positioned to extend upwardly from the roof 9 of the building. A pair of front mounting brackets 27 extend downwardly from the front of the housing with the free ends secured by screws 29 to the top edge of the outer wall of the gutter as shown. The housing further has an inlet or port 31 on the right side as viewed in FIG. 2 and an outlet nozzle 33 in the bottom thereof. The outlet nozzle 33 is tapered and has a restricted opening to speed up the flow of water out of the housing into the mouth of the downspout for reasons which will become apparent later. The nozzle 33 is generally centered in the bottom of the housing 17 and is downwardly and rearwardly directed so that it directs a stream of water downwardly into the downspout. Rotor 19 has a plurality of vanes 35 or impellers affixed to a shaft 37 and is vertically disposed within the housing.

As shown in FIG. 2, a valve 39, constituting means for controlling the flow of water to the motor has its outlet connected to housing inlet port 31. The inlet of valve 39 is connected to a length of flexible tubing 41 formed, for example, of polyethylene. The tubing 41 may be routed along the edge of the roof 9 and down the side of the building 7 for connection to a hose cock or garden hose (not shown) for providing a source of water and power to the motor. When the valve is in an opened position a stream of water flows through tubing 41, valve 39, port 29 and against the vanes 35 of the rotor 19, and when the valve is closed the supply of water to the motor is shut off.

An auger 43 extends downwardly from the housing 17 and is in axial alignment with the opening 11 in the bottom of the gutter 3 and likewise the downspout 5.

Auger 43, which comprises means for breaking up a mass of leaves and other debris blocking the downspout, is suitably connected to the shaft 37 of the rotor 19 within the housing whereby the auger means is driven by the motor.

The apparatus further comprises a valve operating arm 47 and a float 45 which constitute means to open and close the valve. The valve operating arm 47 is pivotally connected to the valve 39 and the float 45 is suitably secured on the outer end of the arm. As particularly shown in FIG. 2, the arm 47 is downwardly disposed and at an angle toward the auger means.

In the operation of this invention, the apparatus 1 is mounted in the position shown with the housing 17 above the opening 11 in the gutter 3 and the mouth of the downspout 5 and the auger means 43 centrally disposed therein. As leaves and other debris accumulate in the gutter and clog the mouth of the downspout, water will accumulate in the gutter during a rainstorm or as snow on the roof melts. As the water level rises, the float will likewise rise in the gutter and rotate the arm 47 toward the housing. This movement will open the valve 39 thereby allowing pressurized water to flow through port 31 and against the vanes 35 of the rotor 19 thereby causing rotation thereof to drive the auger means 43. As water accumulates in the housing, it exits at relatively high pressure through nozzle 33. The rotation of the auger means in conjunction with the directed force of the stream of water from the outlet nozzle will cause the accumulation of leaves and other debris to be forced down the downspout thereby allowing the water in the gutter to flow down the downspout before it begins to wash over the side of the gutter. As the level of water in the gutter drops to a second or lower level, the weight of the float will pull the arm down thereby eventually closing the valve and stopping the flow of water to the motor.

From the above it will be understood that the cleaning apparatus will automatically operate only when needed and will conveniently clean the downspout when it becomes clogged and permit accumulated water and debris in the gutter to move to the downspout for draining.

It will be understood that in most climates this apparatus will only need to be ready for operation on a seasonal basis (principally the autumn months). In addition, in climates where the temperature gets below the freezing mark, the tubing may be conveniently disconnected from the hose cock so that the tubing will drain, thus avoiding any freezing of the water.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A water-powered cleaning apparatus for unclogging a gutter downspout of debris, said apparatus comprising:

a water-powered motor adapted to be mounted above the downspout and having an inlet for connection to a source of water under pressure and an outlet for the discharge of water;

valve means for the water inlet to control the flow of water to said motor;

auger means adapted to be rotated by said motor and positioned within the downspout;

means for opening the valve means when water in the gutter attains a predetermined level in order to actuate said motor by the flow of water from the water source thereby rotating said auger means and for closing the valve means when the level of water drops to a second but substantially lower level thereof; and means for directing the discharge of water from said outlet downwardly into the downspout.

2. A water-powered cleaning apparatus as set forth in claim 1 wherein said water-powered motor comprises a housing and a rotor within the housing for driving said auger means whereby rotation of said rotor causes said auger means to advance debris downwardly through said downspout.

3. A water-powered cleaning apparatus as set forth in claim 1 wherein said valve opening and closing means comprises a pivoted valve operating arm having a float on its outer end whereby when water attains a predetermined level the arm opens the valve means in order to actuate said motor thereby rotating said auger means and when the level of water drops to a second but substantially lower level the arm closes the valve means.

4. A water-powered cleaning apparatus as set forth in claim 1 wherein the discharge directing means is a nozzle, said nozzle being positioned so as to direct a stream of water downwardly into the downspout.

* * * * *